US005724891A

United States Patent [19]

Lovison

[11] Patent Number: 5,724,891

[45] Date of Patent: Mar. 10, 1998

[54] METHOD FOR MANUFACTURING A DISPLAY

[75] Inventor: Douglas I. Lovison, Rancho Santa Fe, Calif.

[73] Assignee: Chromium Graphics, Carlsbad, Calif.

[21] Appl. No.: 670,626

[22] Filed: Jun. 25, 1996

Related U.S. Application Data

[63] Continuation-in-part of Ser. No. 382,132, Feb. 1, 1995, abandoned.

[51] Int. Cl.[6] ..... B41F 1/10; B41F 1/14

[52] U.S. Cl. ..... 101/490; 101/491; 101/211; 101/174; 101/178; 428/13

[58] Field of Search ..... 101/483, 487, 101/490, 424.1, 174, 211, 178, 115, 119, 129, 491; 428/13, 29; 156/184

[56] References Cited

U.S. PATENT DOCUMENTS

| | | | |
|---|---|---|---|
| 1,694,847 | 12/1928 | Donaldson . | |
| 1,867,314 | 7/1932 | Gurwick . | |
| 3,442,742 | 5/1969 | Jorgensen . | |
| 3,622,439 | 11/1971 | Manne et al. . | |
| 3,735,730 | 5/1973 | Mitter . | |
| 3,840,421 | 10/1974 | Peterson . | |
| 4,051,776 | 10/1977 | Zimmer . | |
| 4,092,449 | 5/1978 | Bernstein | 428/29 |
| 4,141,929 | 2/1979 | Stoops et al. . | |
| 4,379,185 | 4/1983 | Smith et al. | 101/115 |
| 4,499,126 | 2/1985 | Suzuki et al. . | |
| 4,500,374 | 2/1985 | Nakazima . | |
| 4,510,863 | 4/1985 | Blaak et al. | 101/219 |
| 4,709,631 | 12/1987 | Davey, Jr. et al. | 101/491 |
| 4,933,218 | 6/1990 | Longobardi . | |
| 4,939,992 | 7/1990 | Bird | 101/211 |
| 4,966,075 | 10/1990 | Brian | 101/490 |
| 5,106,126 | 4/1992 | Longobardi et al. . | |
| 5,118,663 | 6/1992 | Woolf et al. . | |
| 5,132,148 | 7/1992 | Reafler . | |
| 5,145,626 | 9/1992 | Bastioli et al. . | |
| 5,223,357 | 6/1993 | Lovison . | |
| 5,296,340 | 3/1994 | Tsukada et al. . | |
| 5,316,609 | 5/1994 | Guither et al. . | |
| 5,325,781 | 7/1994 | Dupont et al. | 101/487 |
| 5,328,738 | 7/1994 | McKillip et al. | 428/40 |
| 5,333,549 | 8/1994 | Feldman . | |
| 5,383,403 | 1/1995 | Nordvall | 101/424.1 |
| 5,407,711 | 4/1995 | Lovison et al. | 428/13 |
| 5,443,557 | 8/1995 | Hasegawa . | |
| 5,540,875 | 7/1996 | Rubio . | |
| 5,606,914 | 3/1997 | Borgardt | 101/211 |

FOREIGN PATENT DOCUMENTS

| | | | |
|---|---|---|---|
| 0194128 | 9/1986 | European Pat. Off. | 101/424.1 |

OTHER PUBLICATIONS

"New Inus Boost Use of Infrared Dryers on Sheet–Fed–Offset Presses", Inland. Printer/American Lithography, Jun. 1976 pp. 49–50.

*Primary Examiner*—Eugene H. Eickholt
*Attorney, Agent, or Firm*—Nydegger & Associates

[57] ABSTRACT

A system and a method for producing displays such as signs and cards includes a continuous substrate of material which is passed from a supply roller to a take-up roller. A series of printing stations apply a four-color image to the substrate. A fifth printing station then applies a layer of opaque ink to selected portions of the four-color image. Subsequently, a rotating silk screen applies a pattern of viscous translucent ink to form extraordinarily thick ridges on selected portions of the four-color image and opaque ink layer. Finally, a metalized substrate is laminated to the plastic substrate over the various ink layers.

15 Claims, 2 Drawing Sheets

Figure 3
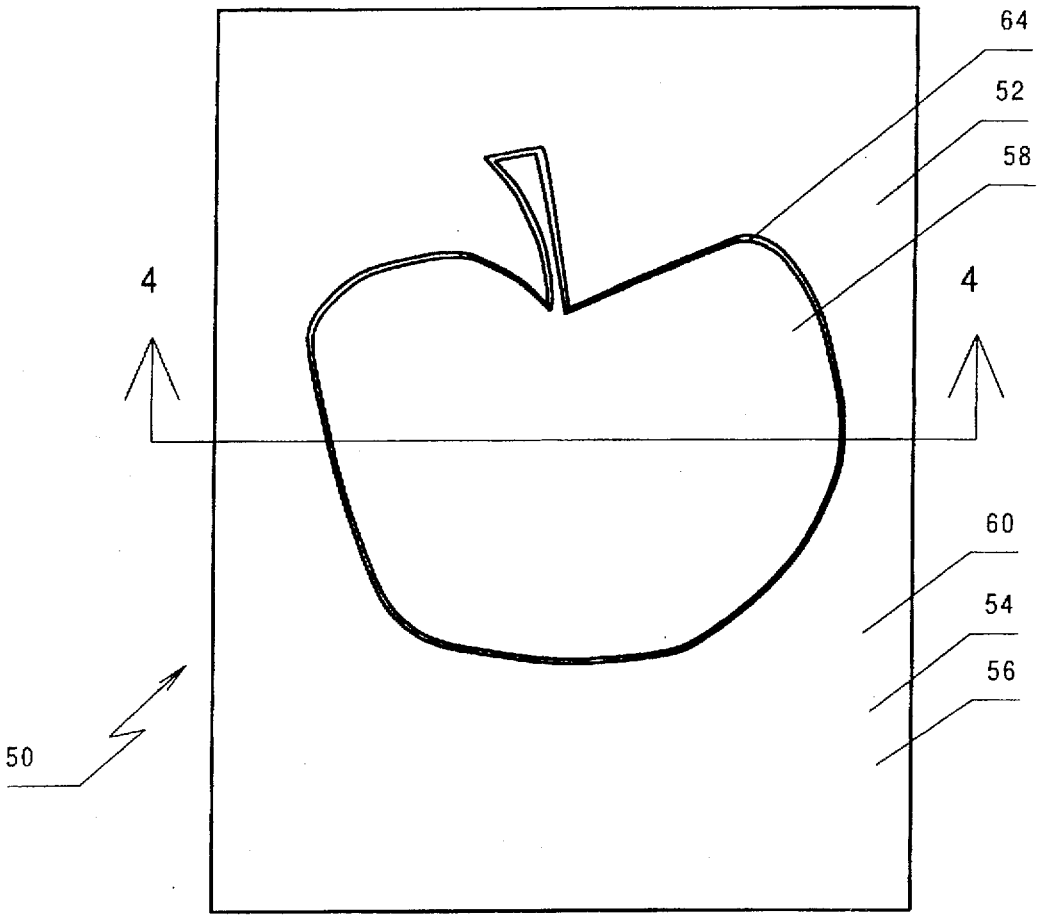
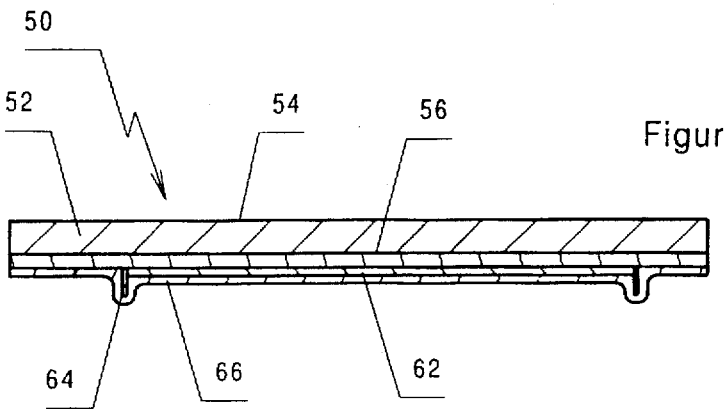
Figure 4

METHOD FOR MANUFACTURING A DISPLAY

This is a continuation-in-part patent application of U.S. patent application Ser. No. 08/382,132, filed on Feb. 1, 1995 and now abandoned, and entitled "Method for Manufacturing a Display".

FIELD OF THE INVENTION

The present invention relates generally to the fabrication of printed materials. More specifically, the present invention relates to methods for continuous production of printed displays including signs and cards and their packaging. The present invention is particularly, but not exclusively, useful as a continuous, roll-to-roll, method for producing metalized cards with enhanced highlights.

BACKGROUND OF THE INVENTION

In the past, the manufacture of displays, such as signs and cards, has generally been performed using a step-by-step, or piecemeal, methodology. Methodologies of this type start with a substrate material upon which a design is to be printed. The substrate is positioned in a printing, or inking station, and a layer of colored ink is applied. The substrate is then moved to a second printing station where a second layer of colored ink is applied. The process of moving the substrate and applying layers of ink is repeated until the desired number of layers have been applied and the design is complete. Often, a so-called four-color process is used where layers of red, yellow, blue, and black inks are sequentially applied. Each of the layers consists of a distinct pattern of dots and the complimentary interaction between the differing dot patterns each composed of a separate color results in a full-color image on the substrate surface.

Generally, step-by-step methodologies are subject to a number of operational disadvantages. For instance, it may be appreciated that each printing station will experience idle periods while it waits for a new substrate to be loaded. As a result, the manufacturing process is slowed and, consequently, the cost of manufacturing the display is increased.

To alleviate this problem, multiple ink printing systems have been developed. These systems allow multiple layers of ink to be applied by the same printing station thereby reducing the number of delays attributable to the process of moving the substrate to successive printing stations. Unfortunately, these systems have proven to be both complex and expensive, limiting the applicability of these systems, especially in cases where production of a low cost product is essential.

A second method for increasing the speed and efficiency of traditional printing systems involves the employment of specialized handling equipment for moving the display substrates between the various printing subsystems. Equipment of this type speeds the manufacturing process by decreasing the delays experienced at each printing station while it waits for a new substrate to be loaded. Equipment of this type, however, is expensive to produce and use and must be carefully designed to avoid damage to the printed design as the substrate moves through the manufacturing process.

A third method for increasing the speed and efficiency of traditional printing systems involves the use of a larger substrate and replication of the display design to produce multiple designs on a single substrate. At the completion of the printing process, the substrate is partitioned and multiple displays are produced. The technique of replication may also be efficiently employed where multiple designs are desired. In practice, however, the replication technique is inherently limited by the difficulty involved in handling large substrates.

In light of the above, it is an object of the present invention to provide a system and a method for manufacturing displays which operates as a continuous and on-going process. It is another object of the present invention to provide a system and a method for manufacturing displays capable of reliably maintaining a high production rate. Yet another object of the present invention is to provide a system and a method for manufacturing displays which functions without the need for expensive or complex handling equipment. Still another object of the present invention is to provide a system and a method for manufacturing displays which is relatively simple to use, is relatively easy to implement and is comparatively cost effective.

SUMMARY OF THE PREFERRED EMBODIMENTS

The present invention is a continuous, in-line system for manufacturing displays, such as signs and trading cards. Structurally, the present invention includes a supply roller, initially wound with a clear plastic substrate, and a take-up roller which is initially empty. The clear substrate has a first side and a second side and is connected to the take-up roller so that the substrate may be transferred from the supply roller to the take-up roller by revolving the take-up roller.

As the clear substrate moves between the supply roller and the take-up roller, it passes sequentially through six printing stations, each followed by a curing oven. The first four of these six printing stations apply a reverse printed four-color image to the second side of the substrate. More specifically, within the first four printing stations, separate patterns of translucent black, translucent yellow, translucent blue and translucent red inks are applied to the second side of the clear substrate. The combined effect of the four patterns and four-colors is to produce a life-like image, or pattern, on the moving substrate. In general, it should be appreciated that the a wide range of differing printing technologies may be used to implement the first four printing stations. In fact, the present invention may utilize any printing technology which can be used to apply the required four-color image to the moving clear substrate.

The fifth printing station applies a pattern of opaque ink to the second side of the clear substrate. The opaque ink is preferably white in color and is applied to create masked, and unmasked, portions of the clear substrate. Like the first four printing stations, the fifth printing station may be implemented using a wide range of differing printing technologies.

The sixth printing station applies a thick, or extraordinarily thick, layer of ink of translucent ink in a selected pattern on the second side of the clear substrate. The translucent ink is preferably of the U.V. curable type and the pattern of ink gives portions of the substrate a textured, or multi-dimensional, appearance. importantly, the translucent ink used in this step must be viscous enough to prevent spreading of the ink on the substrate prior to the substrate entering the curing oven which follows the sixth printing station. This allows the pattern produced by the viscous ink to have clearly defined, or registered, edges and enhances the multi-dimensional effect produced by the translucent ink pattern.

To work in combination with the viscous translucent ink, the sixth printing station is preferably implemented as a cylindrical rotating silk screen. The cylindrical screen is positioned to revolve in contact with the second side of the substrate as it moves from the supply roller to the take-up roller. Importantly, the revolving motion of the cylindrical screen is maintained so that the tangential velocity of the screen equals the linear velocity of the moving substrate. Ink is passed under pressure into the rotating screen and is spread over the inside of the rotating screen by a non-moving blade. As the screen revolves, the ink within the screen moves through a pattern of holes in the surface of the screen. The ink is then applied as a patterned layer of ink dots onto the second side of the clear substrate. The viscosity of the translucent ink requires that the silk screen used in the sixth printing station have a relatively coarse mesh size. Preferably, in fact, a screen which has a mesh size of approximately two-hundred lines per inch is used. The construction of extraordinarily thick ink ridges is described more fully in U.S. Pat. No 4,933,218 which issued to Longobardi for an invention entitled "SIGN WITH TRANSPARENT SUBSTRATE."

A secondary supply roller, initially wound with a metalized substrate, is positioned between the final curing oven and the take-up roller. Like the clear substrate, the metalized substrate has a first side and a second side. Unlike the clear substrate, however, the metalized substrate has a heat and pressure sensitive adhesive applied to the substrate's first side.

A continuous feed of the metalized substrate is passed from the secondary supply roller and over a series of heat shoes. Each heat shoe elevates the temperature of the metalized substrate and activates the adhesive applied on the substrate's first side. The metalized substrate is then placed in contact with the substrate moving between the supply roller and the take-up roller. The combination of the substrate and the metalized substrate pass between an adjacent pair of nip rollers where a combination of heat and pressure laminates the metalized substrate to the clear substrate. The metalized substrate imparts a metallic appearance to those areas of the substrate which have not been masked by the pattern of opaque ink applied by the fifth printing station.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

FIG. 3 is a front elevational view of a display as produced by the present invention; and FIG. 4 is a cross-section of the display produced by the present invention as seen along the line 4—4 in FIG. 5.

DESCRIPTION OF THE PREFERRED EMBODIMENTS

Figure 1:
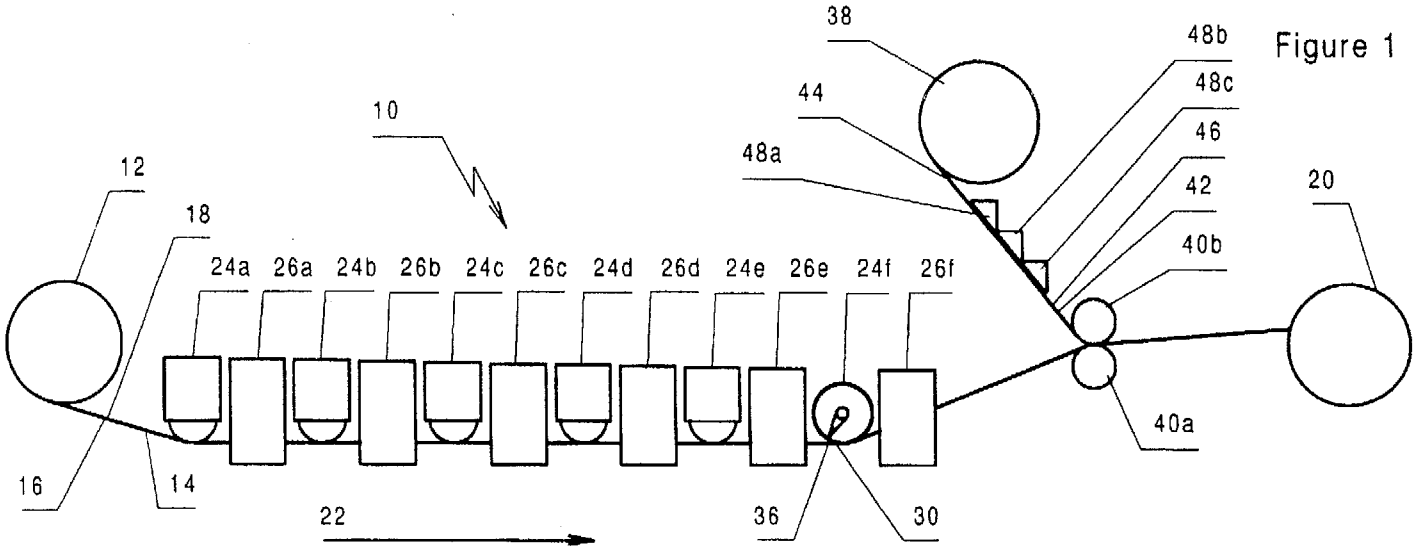
FIG. 1 is an schematic depiction of the apparatus of the present invention.

The present invention is a continuous, in-line system for manufacturing displays, such as signs and trading cards. The structural details of the present invention may be better appreciated by reference to FIG. 1 where the apparatus of the present invention is shown and generally designated 10. Structurally, the apparatus 10 includes a supply roller 12 which is initially wound with a substrate 14 which has a first side 16 and a second side 18 and is preferably composed of clear or translucent plastic. The substrate 14 is connected to a receiving unit, such as take-up roller 20, so that revolution of the take-up roller 20 causes the substrate 14 to unwind from the supply roller 12 and pass to the take-up roller 20. The direction of movement of the substrate 14 between the supply roller 12 and the take-up roller 20 is indicated by the arrow 22. It will be appreciated by the skilled artisan that the receiving unit, in addition to being a take-up roller 20 may be any die cutting, stripping, slitting, scoring, folding or kiss cutting apparatus well known in the pertinent art.

A series of six printing stations **24*a* through 24*f* and a series of six curing ovens 26*a* through 26*f* are positioned between the supply roller 12 and the take-up roller 20. The printing stations 24 and the curing oven 26 are interleaved, so that the substrate 14 passes through a curing oven 26 after passing each printing station 24. The first four printing stations 24, printing stations 24*a* through 24*d*, are designed to apply a reverse printed four-color image to the second side 18 of the substrate 14. As is well known in the pertinent art, application of a four-color image is performed by separately depositing patterns of black, yellow, blue and red translucent inks to the substrate 14. As is also well known in the pertinent art, a range of differing printing technologies, such as intaglio rollers or rotating silk-screens, may be used to apply the ink patterns required for a four-color image. For the purposes of the present invention, any technology which produces the required four-color image at the required resolution may, therefore, be utilized to implement the first four printing stations 24**.

The fifth printing station, **24*e*, is intended to apply a pattern of opaque ink on selected portions of the second side 18 of the substrate 14. The opaque ink is preferably white in color and is applied to establish masked, and unmasked, portions of the substrate 14. The fifth printing station 24*e*, like the first four printing stations 24*a* through 24*d***, may be implemented using any suitable printing technology.

The sixth printing station **24*f*, is intended to apply a pattern of thick, or extraordinarily thick, translucent ink ridges to selected portions of the second side 18 of the substrate 14. Aesthetically, the extraordinarily ridges serve to provide texture, or to impart a multi-dimensional quality to the image being constructed on the substrate 14. To maintain the proper texture or multi-dimensional quality, however, the translucent ink must be prevented from spreading on the substrate 14**. This is accomplished by requiring that the translucent ink be relatively viscous.

Figure 2:
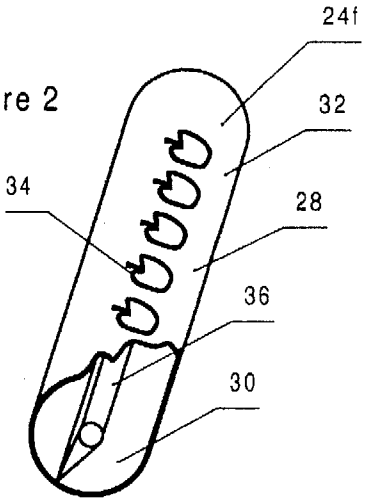
FIG. 2 is an isometric view of the rotating screen of the present invention shown with portions removed to reveal the fixed blade of the present invention.

The structural details which allow the sixth printing station **24*f* to work in combination with the viscous translucent ink may be better appreciated by reference to FIG. 2. In FIG. 2, it may be seen that the sixth printing station 24*f* is constructed as a cylindrical silk screen 28. The cylindrical silk screen 28 has an interior surface 30 and an exterior surface 32. A representative pattern, in this case the outline of an apple, is shown on the surface 32 of the cylindrical silk screen 28, and designated 34. The apple pattern 34 is formed, as is well known in the art of screen printing, by making the cylindrical silk screen 28 transparent to ink at the locations which correspond to the apple pattern 34. Importantly, the mesh size of the cylindrical silk screen 28 is relatively large and is preferably in the range of ???. This allows the viscous translucent ink to move through the pattern 34**.

A fixed blade 32 is positioned inside of the cylindrical silk screen 28 in contact with the interior surface 28. The assembly of the cylindrical silk screen 28 and fixed blade 32 is mounted so that the cylindrical silk screen 28 rotates and the fixed blade 32 remains motionless. The rotation of the cylindrical silk screen 28 is controlled so that the tangential velocity of the rotating cylindrical silk screen 28 matches the linear velocity of the moving substrate 14. The viscous translucent ink is supplied under pressure into the interior of the rotating cylindrical silk screen 28. Once inside of the cylindrical silk screen 28, the viscous translucent ink is spread over the interior surface 30 of the cylindrical silk screen 28 where it passes through the pattern 34. As the cylindrical silk screen 28 revolves, the pattern 34 contacts the second side 18 of the moving substrate 14 repeatedly transferring the viscous translucent ink, in the shape of pattern 34 to the second side 18 of the substrate 14.

As previously mentioned, a curing oven 26 is positioned next to each of the printing stations 24 so that the substrate 14 passes through a curing oven 26 after passing each printing station 24. Importantly, the type of curing oven chosen for each curing oven 26 is matched to the type of ink deposited by the preceding printing station 24. For example, if printing station **24*a* deposits is to deposit inks which are heat curable then a thermal curing oven would be chosen for curing oven 26*a*. For the present invention, it is generally preferably to utilize inks which are curable by exposure to ultra-violet radiation in combination with ultra-violet curing ovens 26**.

Continuing with FIG. 1, it may be seen that the present invention also includes a secondary supply roller 38 and a pair of nip rollers **40*a* and 40*b*. The secondary supply roller 38 is initially wound with a metalized substrate 42 which has a first side 44 and a second side 46. Preferably, the metalized substrate 42 is a metallic foil or mylar and preferably has a heat and pressure activated adhesive compound applied to cover the first side 44. The metalized substrate 42 is passed over a series of heat shoes 48*a*, 48*b* and 48*c* and through the nip rollers 40*a* and 40*b*. FIG. 1 also shows that the clear plastic substrate 14 passes through the nip rollers 40*a* and 40*b*. In fact, the simultaneous passage of the metalized substrate 42 and the clear plastic substrate 14 through the nip rollers 40*a* and 40*b* forces the second side 18 of the clear plastic substrate 14 firmly into contact with the first side 46 of the metalized substrate 42 laminating the metalized substrate 42 to the clear plastic substrate 14**.

OPERATION

A representative display, as may be produced by the present invention is shown in FIGS. 3 and 4 and generally designated 50. As may be seen by reference to those figures, the display 50 includes a substantial flat substrate 52 formed from a clear plastic material. The substrate 52 has a first side 54 and second side 56, and for purposes of illustration, is shown with an image of the apple 58 and background 60 printed on the second side 56. A layer of opaque white ink 62 is printed on the second side 56 of the substrate 54, and covers the image of the apple image 58, but does not cover the background 60. Additionally, an extraordinarily thick ridge 64 is printed on the second side 56 of the substrate 54 at the edge of the apple image 58. Finally, a metallic foil 66 is laminated to the second side 56 of the substrate 52 over the image of the apple 58, layer of opaque white ink 62 and extraordinarily thick ridge 64. The metallic foil 66 imparts a metallic appearance to those areas of the substrate 52 which are not masked by the layer of opaque ink 62 (i.e. the background 60). At the same time, those areas which are masked by the layer of opaque ink 62 (i.e. the image of the apple 58) retain a relatively flat appearance.

To construct the display 50, a substrate 14 is wound on the supply roller 12 of the device 10 of FIG. 1. The substrate 14 is a continuous piece of clear or translucent plastic, from which the smaller substrate 54 of FIGS. 3 and 4 may be partitioned. As the substrate 14 passes between the supply roller 12 and the take-up roller 20, a four-color image is applied by the first four printing stations **24*a* through 24*d*. The image is formed of separate patterns of black, yellow, blue and red translucent inks to the substrate 14. The separate patterns combine to form the four-color image which, in the context of the display 50 of FIGS. 3 and 4, corresponds to the image of the apple 58 and background 60**.

The fifth printing station **24*e* then applies a pattern of opaque ink over to the second side 16 of the substrate 14. The opaque ink is preferably white in color and, for the display 50 of FIGS. 3 and 4, forms the opaque white ink 62 layer which is applied over the image of the apple 58**.

For display 50, application of the opaque ink layer 62, is followed by application of extraordinarily thick ridge 64 at sixth printing station **24*f*. As discussed, extraordinarily thick ridge 64 is applied to surround the image of the apple 58. Importantly, the viscosity of the translucent ink used to form extraordinarily thick ridge 64 prevents spreading of the extraordinarily thick ridge 64 on the substrate 14 prior to curing in oven 26*f***.

Following application of extraordinarily thick ridge 64, the substrate 14 passes through the nip rollers **40*a* and 40*b*. At the same time, the metalized substrate 42, initially wound on secondary supply roller 38, passes past heat shoes 48*a*, 48*b* and 48*c* and between nip rollers 40*a* and 40*b*. Simultaneous passage of the substrate 14 and the metalized substrate 42 through the nip rollers 40*a* and 40*b* laminates the metalized substrate 42 to the substrate 14. In the case of display 50, metalized substrate 42 corresponds to metallic foil 66**.

While the particular system and method for manufacturing displays as herein shown and disclosed in detail is fully capable of obtaining the objects and providing the advantages herein before stated, it is to be understood that it is merely illustrative of the presently preferred embodiments of the invention and that no limitations are intended to the details of the construction or design herein shown other than as defined in the appended claims.

What is claimed is:

1. A method for manufacturing a display which comprises the steps of:

extending a continuous substrate through at least three printing stations between a supply roller and a receiving unit;

rotating said receiving unit to transfer said substrate from said supply roller to said receiving unit;

rotationally depositing translucent inks at a first said printing station to form a pattern on said substrate, said pattern being one of a plurality of sequential said patterns on said continuous substrate;

rotationally depositing opaque ink at a second said printing station onto selected portions of each said pattern on said continuous substrate;

rotationally depositing viscuos translucent ink at a third said printing station to form one or more extraordinarily thick ridges on selected portions of each said pattern on said continuous substrate;

curing said inks on said substrate; and laminating a metalized substrate onto said substrate over said translucent inks, said opaque ink and said viscous translucent ink.

2. A method as recited in claim 1 wherein said viscous translucent ink is deposited using a single pressurized cylindrical screen.

3. A method as recited in claim 2 wherein said pressurized cylindrical screen has a mesh size of two-hundred lines per inch.

4. A method as recited in claim 1 wherein the curing step is accomplished by exposing said viscous translucent ink to ultra-violet radiation.

5. A method as recited in claim 1 wherein the curing step is accomplished by exposing said viscous translucent ink to heat.

6. A method as recited in claim 1 wherein the laminating step is accomplished using a metalized mylar film.

7. A method as recited in claim 1 wherein the laminating step is accomplished using a metal foil.

8. A method as recited in claim 1 wherein the laminating step is accomplished using a heat sensitive adhesive.

9. A method as recited in claim 1 wherein there are a plurality of said first printing stations and said step of rotationally depositing translucent inks is accomplished by separately depositing yellow, blue, red and black inks from respective said first printing stations as required to generate appropriate colors for said pattern.

10. A device for manufacturing displays which comprises:

a supply roller;

a receiving unit;

a continuous substrate, said substrate initially wound on said supply roller, said substrate being transferable to said receiving unit;

a plurality of rotational printing stations, each said printing station positioned between said supply roller and said receiving unit to apply a respective pattern and color of translucent ink to said substrate during transfer of said substrate from said supply roller to said receiving unit to create, in sequence, a plurality of patterns on said continuous substrate;

an additional rotational printing station positioned between said supply roller and said receiving unit to apply a pattern of opaque ink to each said pattern on said substrate during transfer of said substrate from said supply roller to said receiving unit;

a final rotational printing station positioned between said supply roller and said receiving unit to apply extraordinarily thick ridges of viscous translucent ink to each said pattern on said substrate during transfer of said substrate from said supply roller to said receiving unit; and a curing oven positioned between said supply roller and said take-up means to cure said inks during transfer of said substrate from said supply roller to said receiving unit.

11. A device as recited in claim 10 wherein said final rotational printing station is a pressurized cylindrical screen.

12. A device as recited in claim 11 wherein said pressurized cylindrical screen has a mesh size of two-hundred lines per inch.

13. A device as recited in claim 10 wherein the curing oven includes a plurality of lamps each emitting ultra-violet radiation to cure said viscous translucent ink.

14. A device as recited in claim 10 wherein the curing oven includes a plurality of lamps each emitting infrared radiation to cure said viscous translucent ink.

15. A device as recited in claim 10 further comprising means for laminating a metalized substrate to said substrate with said extraordinarily thick ridges of viscous translucent positioned therebetween.

* * * * *